United States Patent [19]

Dewing et al.

[11] Patent Number: 4,668,351

[45] Date of Patent: May 26, 1987

[54] METHOD OF PRODUCING ALUMINUM

[75] Inventors: Ernest W. Dewing; Douglas N. Reesor, both of Kingston, Canada

[73] Assignee: Alcan International Limited, Montreal, Canada

[21] Appl. No.: 754,830

[22] Filed: Jul. 12, 1985

[30] Foreign Application Priority Data

Jul. 13, 1984 [GB] United Kingdom ..... 8417851

[51] Int. Cl.[4] ..... C22B 9/10; C22B 21/00; C25C 3/06; C25C 3/24

[52] U.S. Cl. ..... 204/67; 75/63; 75/68 R; 75/93 R

[58] Field of Search ..... 204/67, DIG. 13, 71; 75/68 R, 93 R, 93 AC, 63

[56] References Cited

U.S. PATENT DOCUMENTS 4,470,846 9/1984 Dubé75 ..... 68 R/

FOREIGN PATENT DOCUMENTS 620071 3/1949 United Kingdom ..... 75/63

*Primary Examiner*—Howard S. Williams

*Attorney, Agent, or Firm*—Cooper, Dunham, Griffin & Moran

[57] ABSTRACT

A method of purifying aluminum contaminated with cerium or other rare earth metal comprises bringing the molten metal into contact with a halogenating agent. Preferred halogenating agents are aluminum fluoride for reducing cerium levels to around 0.1% to 0.3%, and chlorine gas for reducing cerium levels still further, and these may advantageously be used in sequence. Particulate aluminum fluoride may be introduced into the vortex of a stirred body of the molten metal. The controlled addition of chlorine may be effected by bubbling a mixture of chlorine and an inert gas into a body of the molten metal. The cerium contamination may arise from the use of a dimensionally stable anode comprising cerium dioxide in an aluminum reduction cell.

11 Claims, 1 Drawing Figure

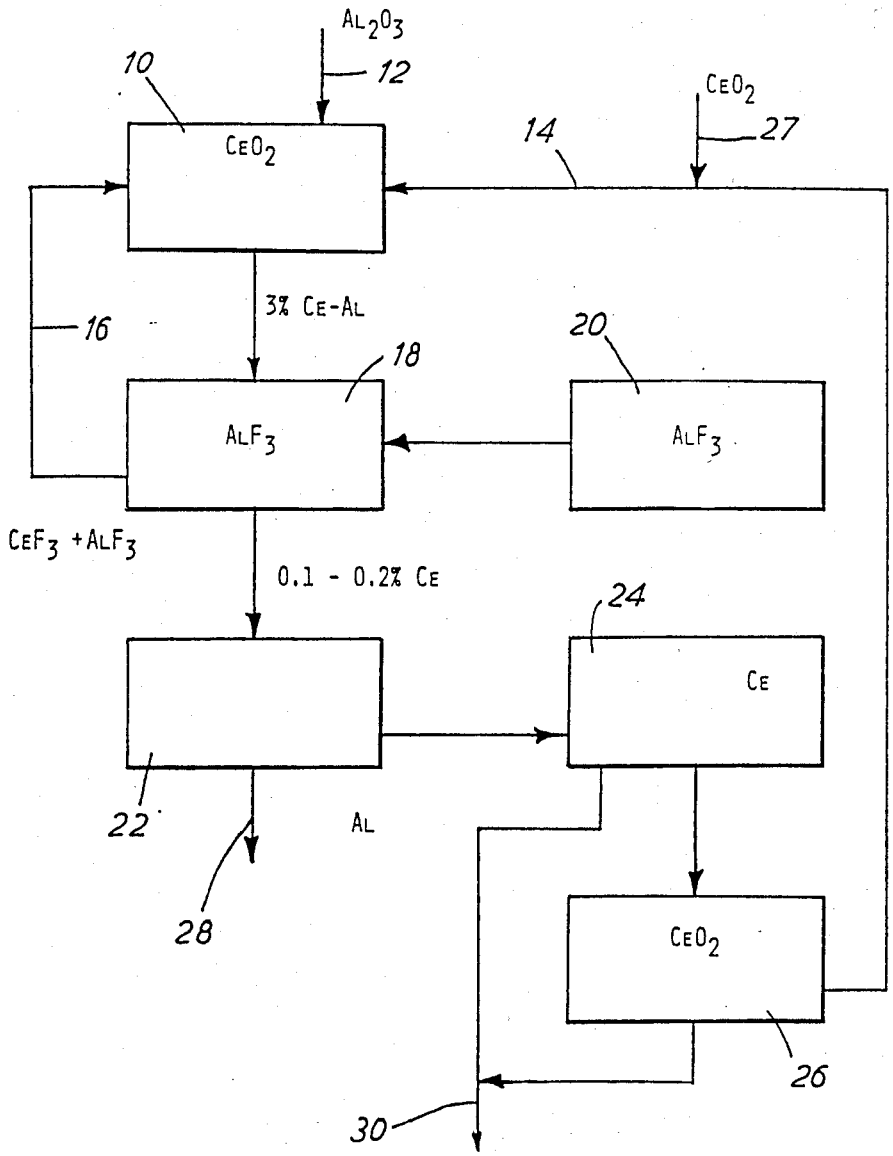
AL2O3
12
10
CEO2
14
CEO2
27
3% CE-AL
16
20
18
ALF3
ALF3
CEF3 +ALF3
0.1 - 0.2% CE
24
CE
22
AL
28
CEO2
26
30

METHOD OF PRODUCING ALUMINUM

This invention relates to a method of producing aluminum free from contamination by cerium and other rare earth metals.

In the conventional Hall-Heroult cell for aluminum production, one or more overhead anodes of carbonaceous material are suspended in an electrolyte of molten cryolite containing dissolved alumina. The cell cathode may be a pool of molten product aluminum metal on the floor of the cell, or a solid cathode mounted in the floor may be provided. Passage of electricity through the cell generates aluminum at the cathode and carbon oxides at the anodes, as a result of which the carbonaceous anodes are progressively consumed. Thus the life of a pre-bake anode is typically 2–3 weeks, after which time the butt must be removed and a fresh anode installed.

During the century or so since Hall and Heroult designed their cell, many proposals for dimensionally stable anodes have been put forward, but none has achieved commercial success. A promising approach described in European Patent Specification No. 114085 A involves providing a protective coating of an oxide of cerium or other rare earth element on the surface of the anode. The coating may be formed in situ by including a minor proportion of cerium or other rare earth metal compound in the electrolyte. During operation of the cell, an equilibrium is set up between trivalent cerium or other rare earth metal ion dissolved in the electrolyte, and a protective oxide coating of tetravalent cerium or other rare earth metal on the surface of the anode. Even when the protective coating on the anode is preapplied, an equilibrium is set up between rare earth metal oxide in the coating and rare earth metal ion in the electrolyte.

Unfortunately, a proportion of the cerium or other rare earth metal ion in the electrolyte is reduced during electrolysis to zero valency, in which state it alloys with and contaminates the molten product aluminium. The contaminant concentration depends on various factors but may reach as high as 4%. For various reasons, this contamination is not desired. Cerium is fairly expensive and needs to be recovered for re-use, and the same is even more true of other rare earth metals. The contaminant may spoil the metallurgical properties of aluminum and is not a constituent of the commonly used aluminum alloys. This invention is concerned with the problem of removing the contaminant.

The present invention provides a method of purifying a molten metal comprising aluminum contaminated with cerium or other rare earth metal which method comprises bringing the molten product metal into contact with a halogenating agent selected from chlorine, aluminum chloride and aluminum fluoride to convert contaminant cerium or other rare earth metal to a halide, and separating the contaminant halide from the molten product metal.

Reference has been made above to cerium or other rare earth metals. It is likely that cerium would be used in practice, but where reference is made below to cerium, it should be understood that other rare earth elements are also contemplated.

In the electrolytic cell, cerium is reduced from the fluoride to the metal. It is therefore somewhat surprising that thermodynamic conditions permit aluminum fluoride to be used to convert cerium metal to cerium fluoride in the presence of aluminum.

The equilibrium constant (K) for the reaction $$AlF_3 + Ce = CeF_3 + Al \quad (1)$$

is $$K = \frac{a_{CeF_3}}{a_{AlF_3}} \cdot \frac{a_{Al}}{a_{Ce}}, \quad (2)$$

where "a" represents thermodynamic activity. Of these quantitites $a_{Al}$ is approximately 1 since substantially pure Al is always present. Hence the activity of cerium, which governs the quantity of cerium in the metal, is given by $$a_{Ce} = (1/K).a_{CeF_3}/a_{AlF_3}. \quad (3)$$

It follows that raising the activity of aluminum fluoride will lower the activity of cerium and drive reaction (1) to the right.

In the electrolyte of a typical electrolysis cell the activity of $AlF_3$ is of the order of $10^{-3}$ (with respect to the pure solid as standard state). If, therefore, metal which has been equilibrated with such an electrolyte (containing also $CeF_3$) is removed from the cell and brought into contact with $AlF_3$ at unit activity, the cerium content of the metal will be to some extent converted to $CeF_3$. It was not predictable how fast or how far that reaction would go.

It was also somewhat surprising that thermodynamic considerations favor the conversion of cerium metal to cerium chloride using aluminum chloride or chlorine gas in the presence of aluminum metal. Even after it had been established that these halogenation reactions were thermodynamically possible, it was not predictable whether they would go with sufficient speed and efficiency to be practicable.

For many purposes, aluminum fluoride is the preferred halogenating agent. It has the advantage that its use leads to no net loss of product, since for every mole of cerium converted from metal to fluoride, a mole of aluminum is converted from fluoride to metal. Its use furthermore gives rise to a mixture of aluminum and cerium fluorides which can simply be recycled to the electrolytic cell to make up for operating losses of fluoride and cerium. Aluminium fluoride and cerium fluoride and mixtures of the two are solid at likely operating temperatures and are not significantly wetted by aluminum, so that they are easily separated from molten aluminum.

Aluminium fluoride is conventionally used to purify molten aluminum from alkali metal, and alkaline earth metal contaminants. With the proviso that the cerium concentration (at up to 4%) may be much higher than the alkali or alkaline earth metal concentration (at up to 100 ppm), the same techniques may be used. The contaminated molten product metal may be passed through a granular bed of, or containing, aluminum fluoride. More preferably, particulate aluminum fluoride may be introduced into the vortex of a stirred body of contaminated molten product metals according to the method described in European Patent Specifications Nos. 65854 and 108178. Stirring is continued for a sufficient time to effect reaction to a desired extent, after which the product metal is allowed to settle. Cerium fluoride either floats to the surface, from which it is easily skimmed off, or adheres to the walls of the retaining vessel and remains behind when the purified metal is poured off.

In order to keep the cerium concentration in the electrolyte on a constant level (to maintain the $CeO_2$ layer on the anode) the amount of recycled cerium should be balanced with the amount of cerium which goes from the electrolyte into the product metal plus that which is lost from the system by other means.

In a typical reduction cell it is necessary to add about 15–20 kg. of $AlF_3$ per tonne of metal produced in order to maintain the fluorine balance in the system. This amount of $AlF_3$ is thus available at no extra cost for use in the presently contemplated process, since its conversion to $CeF_3$ before introduction into the cell does not change the fluorine balance. Thus the process is very favorable economically provided that no more than this amount of $AlF_3$ is needed to remove cerium from the product aluminum.

If this amount of $AlF_3$ is not sufficient to remove all the cerium from the product then more must be used, but obviously such additional $AlF_3$ must be paid for and it ultimately ends up as unwanted cryolite bath. The process is technically feasible but the economics deteriorate progessively as the amount of $AlF_3$ used exceeds that which is necessary to maintain the fluorine balance.

The rate of reduction in cerium concentration of the product metal depends also on the temperature, being greater at higher temperatures, and on the stirring. Stirring times of 1 to 60 minutes are typical. It may be useful to add the aluminum fluoride in increments, with a period of stirring followed by settling and skimming following each incremental addition. Temperature limits are generally set by the need to keep the product metal molten and to avoid excessive volatiliation of the fluorides.

Instead of using pure solid aluminum fluoride as a halogenating agent, it is quite possible, and may be desirable to use a cryolite bath rich in aluminum fluoride. Although the $AlF_3$ activity may not be quite unity, it is sometimes advantageous to handle a liquid instead of a solid, and the liquid also provides a solvent for the cerium fluoride which is formed. Such a bath may preferably be made by adding aluminum fluoride to electrolyte withdrawn from a cell.

It is impossible using aluminum fluoride to reduce the contaminant cerium concentration much below 0.1% because that is the level set by equilibrium (1) above. It is therefore preferred to use aluminum fluoride in an amount of from 95% to 140% of the stoichiometric amount required for reaction with all the cerium (or other rare earth metal) present, and to continue treatment for long enough to reduce the cerium content to a level in the range 0.1% to 0.3%. Further reduction of the cerium content of the molten metal is best effected using chlorine.

Chlorine gas may be used to precipitate cerium preferentially to aluminum, provided that the chlorine addition is controlled (either by small dosage or by admixture with an inert gas) to keep activity low enough. The use of chlorine as a halogenating agent is preferred for molten metals contaminated with less than 0.3% of cerium. By bubbling chlorine through the contaminated product metal, the cerium content can readily be reduced to 50 ppm in a reasonable time. Instead of using pure chlorine, a mixture of chlorine with an inert gas such as nitrogen may be used to provide better agitation and better metal/gas contact. The metal/gas contact may be further improved by stirring the metal. If the temperature is kept below 800° C., the cerium chloride separates as a solid and is easily removed by skimming.

As a halogenating agent, aluminum chloride is generally less preferred than aluminum fluoride, because it is undesirable to add chlorides to an electrolytic cell since they ultimately lead to corrosion and environmental problems. Also aluminum chloride, being a gas at the temperatures in question and very subject to reaction with moisture, is difficult to handle. It is, of course, formed in situ any time that chlorine is brought into contact with molten aluminum so that the description given above of the effects of chlorine generally applies to aluminum chloride.

As noted above in relation to aluminum fluoride, the amount of halogenating agent must be at least stoichiometric with the amount of cerium to be removed. Larger amounts may improve reaction kinetics. Contact times should be sufficient to effect the desired reduction in cerium content and will generally be in the range of 1–60 minutes. When the cerium is separated as cerium chloride, it may be converted to the fluoride, by known techniques, prior to being recycled to the electrolytic reduction cell, or may be returned direct to the cell without prior treatment.

Reference is directed to the accompanying drawing which is a flowsheet showing one embodiment of the invention.

Referring to the drawing, an aluminum reduction cell 10 is fed with $Al_2O_3$ via line 12, with $CeO_2$ via line 14, and with a $CeF_3/AlF_3$ mixture via line 16. The product metal, an Al - 3% Ce alloy passes to a station 18 for treatment with $AlF_3$ supplied from a plant 20. While the dross and mixed fluorides are recycled to the cell 10, the product metal, now contaminated with only 0.1 - 0.2% Ce, passes to a station 22 for treatment with chlorine. The skim is leached at 24 for cerium recovery, and the cerium oxidised at 26 to $CeO_2$ which is mixed with fresh $CeO_2$ at 27 and recycled via line 14 to the reduction cell 10. The unwanted residue from stations 24 and 26 passes to waste at 30. Pure product metal is recovered at 28 from the chlorine treatment.

The following Examples illustrate the invention. The cerium-contaminated aluminum samples were specially prepared for the purposes of this invention.

EXAMPLE 1

150 kg of Al 3.5 weight percent Ce was heated to 780° C. 2.1 kg of $AlF_3$ powder was stirred into the melt with an impeller. After 20 minutes the melt was skimmed and a sample of metal was found to contain 1.57 weight percent Ce. A further 1.55 kg of $AlF_3$ was then stirred into the melt for 20 minutes after which the remaining aluminum was found to contain 0.55 weight percent Ce.

EXAMPLE 2

150 kg, of Al-0.5% Ce alloy was treated at about 800° C. with 1 kg of aluminum fluoride powder. The powder was stirred into the aluminum for 30 minutes. Samples taken after the dross had been removed analysed 0.10 weight percent cerium. Another kilogram of aluminum fluoride powder was stirred into the melt for 30 minutes. After removing the dross a sample was taken which analysed at 0.097 weight percent cerium. The addition of 1 kg of $AlF_3$ was repeated again. After another 30 minutes of stirring the cerium concentration of the melt was 0.089 weight percent.

EXAMPLE 3

Pure $Cl_2$ gas was bubbled at a rate of about 1 L/min through a 4.5 kg Al-Ce alloy for 10 minutes. The Ce concentration fell from a value of 0.097 weight percent, corresponding to the material left at the end of Example 2 Stage 1, to 0.015 weight percent.

Example 4

A 90% $N_2$-10% $Cl_2$ gas mixture was bubbled through 68 kg of Al-0.15% Ce alloy at a rate of approximately 14 L/min. The target temperature of the metal was 800° C. Over a 72 minute period the Ce concentration was reduced to 0.045 weight percent.

EXAMPLE 5

A 90% $N_2$-10% $Cl_2$ gas mixture was bubbled through 68 kg of Al-0.15% Ce alloy at a rate of 20 L/min. The target metal temperature was 800° C. An impeller was stirring the aluminum at a rate of 800 r.p.m. The concentration of Ce was reduced to less than 0.005 weight percent in 25 minutes.

We claim:

1. A method of purifying a molten metal comprising aluminium contaminated with cerium or other rare earth metal, which method comprises bringing the molten metal into contact with a halogenating agent selected from chlorine, aluminum chloride and aluminum fluoride to convert contaminant cerium or other rare earth metal to a halide, and separating the contaminant halide from the molten product metal.

2. A method as claimed in claim 1, wherein the molten metal is contaminated with from about 0.1–4% of cerium, and aluminum fluoride is used to convert contaminant cerium to cerium fluoride.

3. A method as claimed in claim 2 wherein aluminum fluoride is used in an amount of from 95% to 140% of the stoichiometric amount required for reaction with all the cerium or other rare earth metal present.

4. A method as claimed in claim 1 wherein particulate aluminum fluoride is introduced into the vortex of a stirred body of the contaminated molten metal to convert cerium or other rare earth metal to a fluoride.

5. A method as claimed in claim 1, wherein the molten metal is contaminated with up to about 0.3% of cerium, and chlorine is used to convert contaminant cerium to cerium chloride.

6. A method as claimed in claim 5, wherein controlled addition of chlorine is effected by bubbling a mixture of chlorine with an inert gas into a body of the molten metal.

7. A method as claimed in claim 1 wherein the purification treatment is effected in two stages, the first stage comprising contacting the molten metal with aluminum fluoride, and the second stage comprising contacting the molten metal with chlorine.

8. A method as claimed in claim 7, wherein the first stage is effected to an extent to reduce the cerium content of the molten metal down to a level of 0.1% to 0.3%, and the second stage is effected to an extent to further lower the cerium content of the molten metal.

9. A method of producing aluminum by electrolysis of a molten fluoride electrolyte containing dissolved alumina, said electrolyte containing cerium or other rare earth metal ion in the trivalent state in a concentration to maintain a tetravalent oxide coating on the surface of the anode, recovering molten product metal comprising aluminum contaminated with cerium or other rare earth metal, bringing the molten product metal into contact with a halogenating agent selected from chlorine, aluminum chloride and aluminum fluoride to convert contaminant cerium or other rare earth metal to a halide, and separating the contaminant halide from the molten product metal.

10. A method as claimed in claim 9, wherein the cerium or other rare earth metal halide is recycled to the electrolyte of an aluminum reduction cell.

11. A method as claimed in claim 9 wherein the product metal is contaminated with about 0.1% to 4% of cerium, aluminum fluoride is used to convert contaminant cerium to cerium fluoride, and a mixture of unreacted aluminum fluoride and cerium fluoride is separated from the molten product metal and recycled to the electrolyte of the aluminum reduction cell.

* * * * *